United States Patent [19]

Jacob et al.

[11] Patent Number: 4,733,429

[45] Date of Patent: Mar. 29, 1988

[54] VACUUM CLEANER

[75] Inventors: Gernot Jacob, Weissach-Flacht; Leon Radom, Ellhofen, both of Fed. Rep. of Germany

[73] Assignee: Progress-Elektrogerate Mauz & Pfeiffer Gmbh & Co., Fed. Rep. of Germany

[21] Appl. No.: 802,118

[22] Filed: Nov. 25, 1985

[30] Foreign Application Priority Data

Nov. 30, 1984 [DE] Fed. Rep. of Germany ..... 3443837

[51] Int. Cl.[4] ..... A47L 9/12

[52] U.S. Cl. ..... 15/327 R; 15/326; 15/412; 55/473

[58] Field of Search ..... 15/412, 413, 327 E, 15/327 R, 326; 55/473

[56] References Cited

U.S. PATENT DOCUMENTS

| | | | |
|---|---|---|---|
| 2,135,036 | 1/1938 | Karlstrom | 55/473 X |
| 2,190,470 | 2/1940 | Edstrom | 55/473 X |
| 2,498,063 | 2/1950 | Binggely | 55/473 |
| 2,964,777 | 12/1960 | Allen et al. | 55/473 X |
| 3,172,743 | 3/1965 | Kowalewski | 55/473 X |

*Primary Examiner*—Chris K. Moore

*Attorney, Agent, or Firm*—Kline, Rommel & Colbert

[57] ABSTRACT

The motor 3 of the vacuum cleaner is surrounded by the elastomeric shroud 4, which is air-tightly joined to the blower 2. The blower 2 moves the drawn in air into the space defined by the shroud, which the air can only leave through the air outlet ports 13 formed in the wall of the shroud. Behind the air outlet ports 13 there is a filter 10, which cleans the air coming from the shroud. The air passes into the space between the shroud and the vacuum cleaner housing, where it is distributed and comes to rest. It passes through numerous air outlet ports 15 in the vacuum cleaner housing at a low speed.

9 Claims, 4 Drawing Figures

VACUUM CLEANER

This invention relates to improvements in vacuum cleaners.

In conventional vacuum cleaners the air emerging from the vacuum cleaner housing causes some problems. Although the air drawn into the blower, which is heavily laden with dust, is normally caused to pass completely through the dust bag, in which dust particles over a certain size are retained, the air passing through the dust bag and into the motor space before emerging from the vacuum cleaner housing still carries with it a substantial amount of minute particles which are likely to be harmful to humans. This is more especially the case when in conventional vacuum cleaners the air is allowed to emerge with a substantial pressure from air slots placed close to each other so that there is an additional swirling of the dust.

A primary object of this invention is the provision of a vacuum cleaner housing including a filter medium for removing impurities from the air as it passes through the vacuum cleaner housing.

In accordance with this the invention provides the feature that the motor is enclosed by a shroud that is connected in an air-tight manner with the blower, such shroud having air outlet ports but otherwise surrounding the motor in an air-tight manner. The construction means that there is an additional closed space within the motor space, into which the blower propels air that it draws in. The drawn in air then emerges from this shroud through air outlet ports therefor and passes through same into the space left between the vacuum cleaner housing and the shroud. On the outside of the air inlet ports of the shroud there is an air filter which is so placed that air coming out of the air outlet ports passes through it. The emerging air is therefore freed of practically all harmful substances so that after it emerges from the vacuum cleaner it will not be able to have any harmful effects on the surroundings.

In this construction in accordance with the invention the air outlet ports may be placed so that they are closely adjacent, so that the air may be passed through a comparatively small air filter without this having any harmful effect on the surroundings of the vacuum cleaner as the concentrated airflow, issuing from the shroud and cleaned at the outlet port, does not leave the vacuum cleaner at a comparatively high pressure, but firstly makes its way into the space between the vacuum cleaner housing and the shroud in which the cleaned air is firstly distributed and comes to rest.

It is expedient, if the air outlet ports of the vacuum cleaner housing are formed so as to be distributed in such a large number over substantial areas of the vacuum cleaner housing, that the air emerges with a wide distribution from the vacuum cleaner housing. The air emerging with a low pressure and well distributed from the vacuum cleaner housing is practically not able to be detected even right near the vacuum cleaner and is not able to cause any troublesome swirling of the dust.

It is furthermore an advantage if a valve is formed in the shroud wall which is opened at a given degree of gage pressure in the shroud so that the drawn in air is able to emerge from the shroud. Since the user of a vacuum cleaner will not in every case be informed about the condition of the filter, through which the air has to flow when it leaves the vacuum cleaner housing and the shroud, it is quite possible for the filter not to be timely changed. However as the filter becomes increasingly clogged there will be an increase in the pressure in the shroud joined to the blower so that the suction effect of the vacuum cleaner will become less and less. When eventually the filter has become completely clogged, the blower will be unable to draw any more air into the shroud so that the vacuum cleaner in this state will not have any cleaning effect at all. Then a user who does not pay much attention to the vacuum cleaner will be likely to come believe that the complete vacuum cleaner is defective. This problem is solved by arranging a valve in the shroud wall which is opened at a certain pressure level, due to a filter having become clogged to a certain degree, so that the drawn in air may flow out of the shroud. In this case the emerging air is admittedly not clean but the vacuum cleaner will still be able to function.

It is convenient if the valve is in the form of a flap formed in the shroud wall. At a given level of gage pressure this flap will become unlocked and will be able to be closed again by the user so that after replacement of the filter all the air will be cleaned. The construction of the valve as a flap is particularly simple and low in price.

In this case it is an advantage if the opening of the flap is indicated optically, electrically or acoustically. In this case the flap may be colored conspicuously and so placed that when it is opened it will be visible through the air outlet ports in the vacuum cleaner housing. This signal will then provide an indication to the user of the vacuum cleaner that the filter is due to be changed.

In place of an optical indication it is possible for an electrical signal to be generated by switching on a lamp or producing an acoustic signal that is caused for example by air emerging from the opened flap producing a whistling sound. The indication that the flap is open will reliably prevent a person, who is familiar with the vacuum cleaner, remaining in ignorance of the non-functional condition of the filter.

The filter is preferably fitted with a cassette frame which will make it easier to handle. It is an advantage if a frame running around the outlet ports is mounted on the outer side of the shroud into which the filter cassette frame may be slid so as to make an air-tight connection. In this case the frame of a hand vacuum cleaner is preferably molded on one side of the shroud, the filter being able to be slid in, from the lower side of the housing, upwards in a vertical direction, whereas in the case of a floor-supported vacuum cleaner the frame may be molded on the lower side of the shroud and the filter will then be introduced on the level.

It is convenient if the filter is supported in the frame by rails so that it will not be bent by the air flowing through with a substantial pressure, such bending otherwise leading to substantial damage. The filter is preferably a fine filter and a handle is molded on the cassette frame with which the filter may be slid in and pulled out in a particularly convenient manner.

As a further particularly advantageous feature of the invention it is possible for a bearing ring to be integrally molded for the blower and which is connected with the shroud via ribs. In this case the shroud is preferably made of a material with elastomer components. This design brings with it a substantial simplification of the means for supporting the motor, since the shroud replaces the rear bearing ring so far used in known vacuum cleaners, since in itself it is able to damp the vibrations of the motor to a sufficient degree. Owing to the fact that in addition the front bearing ring is molded on the shroud, the construction of this part of the vacuum cleaner is particularly simple and low in price.

To make certain that the air emerging from the vacuum cleaner housing is hardly detectable even right next to the vacuum cleaner, the vacuum cleaner housing may be perforated at least in part.

Further features, details and advantages of the invention will be seen from the ensuing description of some preferred examples thereof and on the basis of the drawings.

Figure 1:
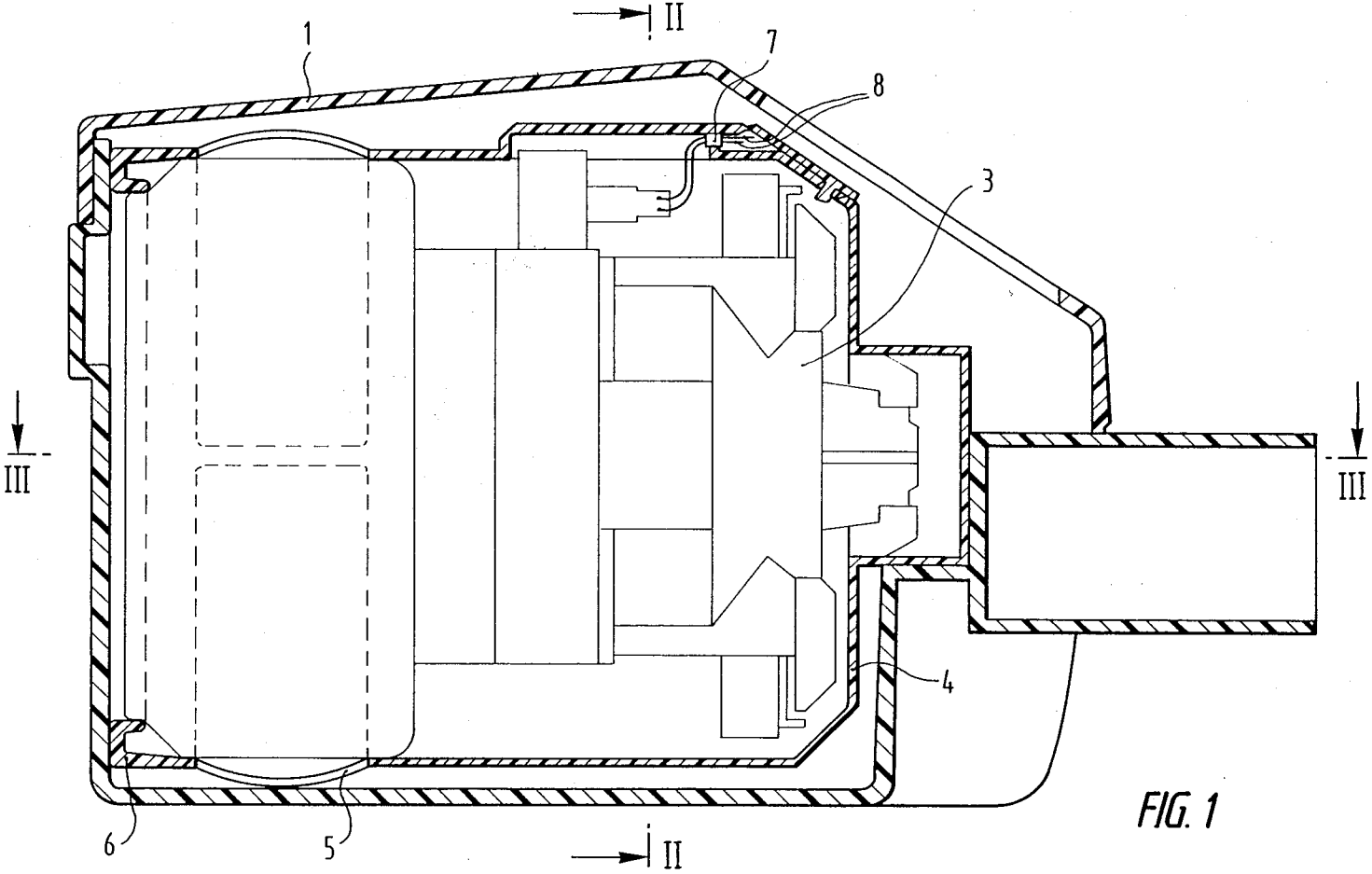
FIG. 1 is a longitudinal section taken through the motor space of an embodiment of the vacuum cleaner in accordance with the invention.
Figure 2:
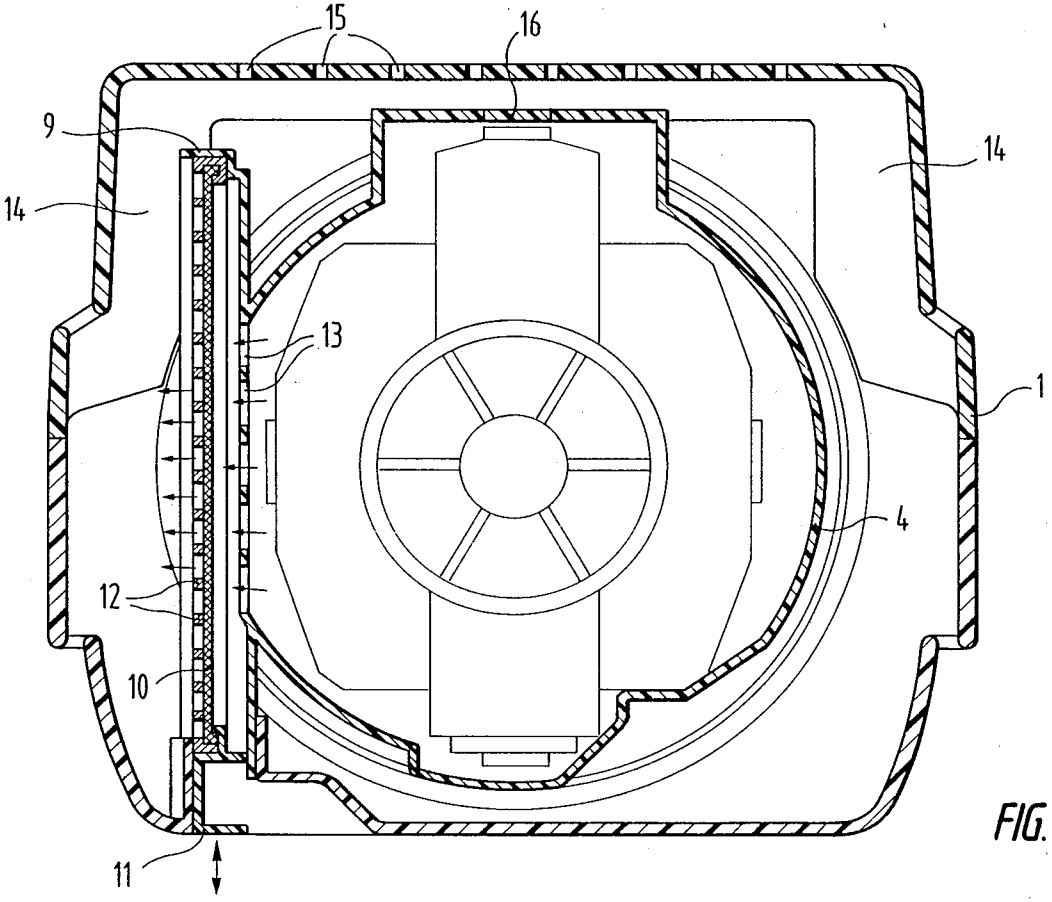
FIG. 2 is a section taken on the line II—II of FIG. 1.
Figure 3:
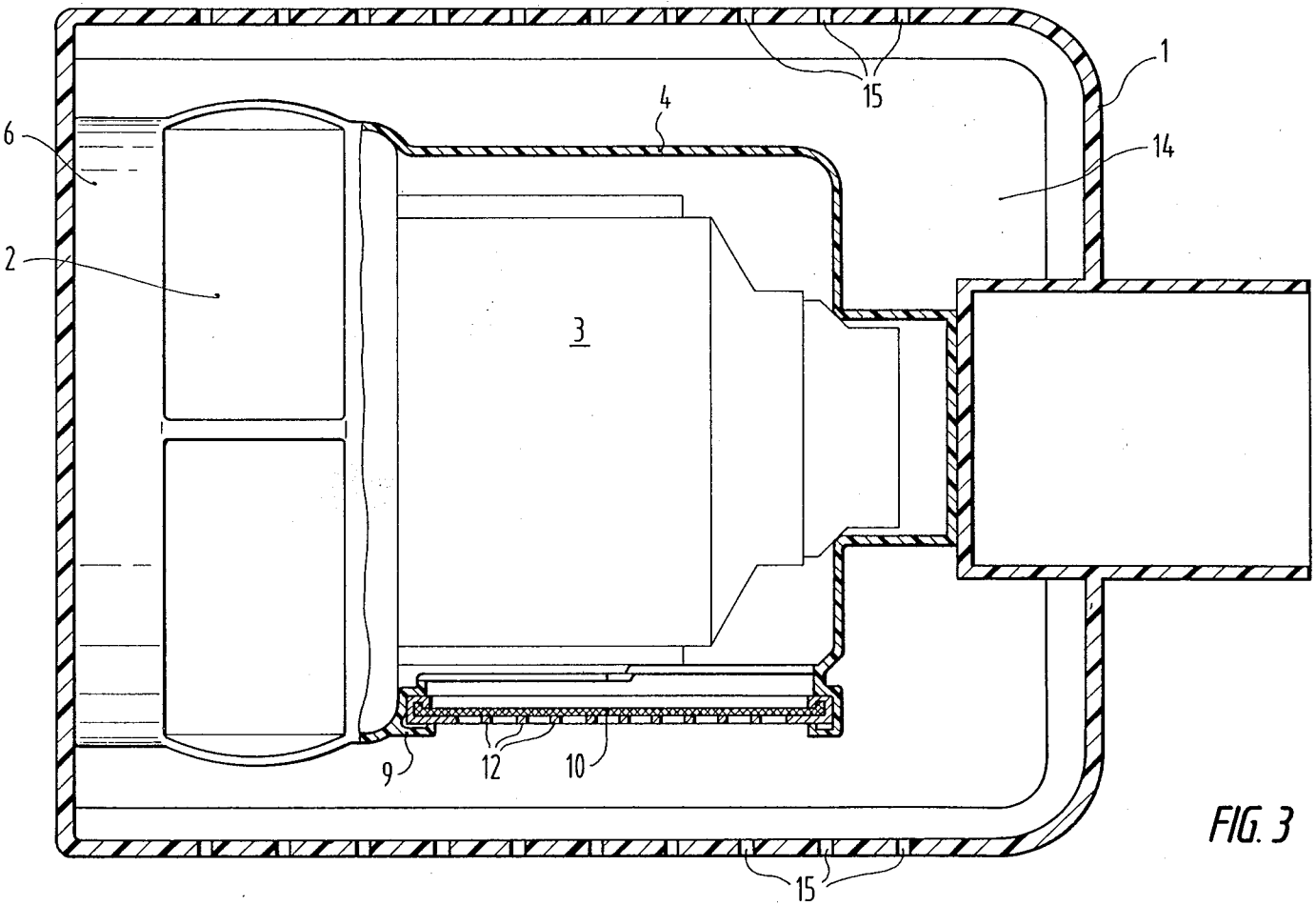
FIG. 3 is a section taken on the line III—III of FIG. 1.

In FIGS. 1 to 3 it will be seen that the motor space of a hand vacuum cleaner is represented. The motor space is enclosed by the back part of the vacuum cleaner housing 1, and in its end part adjacent to the front dust space (not shown) it contains a blower 2 which draws in air through the dust space and into the motor space. Behind the blower 2 the motor 3 is placed, driving the blower.

The motor 3 is enclosed within a shroud 4 which air-tightly adjoins the blower. This creates a closed space containing the motor adjacent the back side of the blower 2, and the air may escape from this space only through outlet ports provided for this purpose.

The shroud consisting of an elastomeric resin at the same time serves as a support for the motor so that it is not necessary to have an additional bearing ring in the back part of the motor. On the front end part of the shroud 4 ribs 5 are molded which are joined to the bearing ring 6 of the blower 2, the bearing ring 6, the ribs 5 and the shroud being produced integrally. The shroud 4 has through holes 7 in its rear upper part through which the connection cables 8 are so passed that the through holes are air-tightly plugged.

As will more especially be seen from FIGS. 2 and 3, a frame 9 is molded on one side of the shroud 4 to the outside thereof, which serves to receive a filter 10. The filter 10 is moved into the frame 9 from the floor side of the vacuum cleaner housing 1 using a handle 11, which is provided with the filter. The filter 10 is supported by the ribs 12 so that it will not be bent and damaged by air flowing with a high pressure through air outlet openings 13 in the wall of the shroud 4. In this respect the air emerging through the air outlet ports 13 necessarily has to flow through the filter 10 in order to be able to move into the space 14 between the vacuum cleaner housing 1 and the shroud where the emerging air, moving at a high speed, will be distributed and will come to rest.

The air emerges from numerous air outlet ports 15 in the vacuum cleaner housing 1 into the surroundings of the vacuum cleaner without containing any harmful substances, since it leaves the vacuum cleaner housing with a lower pressure and at a low speed.

In the upper part of the shroud 4 a flap 16 is formed, which, when the pressure in the shroud 4 has built up to a certain value, is opened by the internal pressure. This ensures that the vacuum cleaner is not made inoperative by a more or less completely clogged filter 10, since in such a case, the air drawn into the motor space by the blower leaves the opening left by the opened flap.

Figure 4:
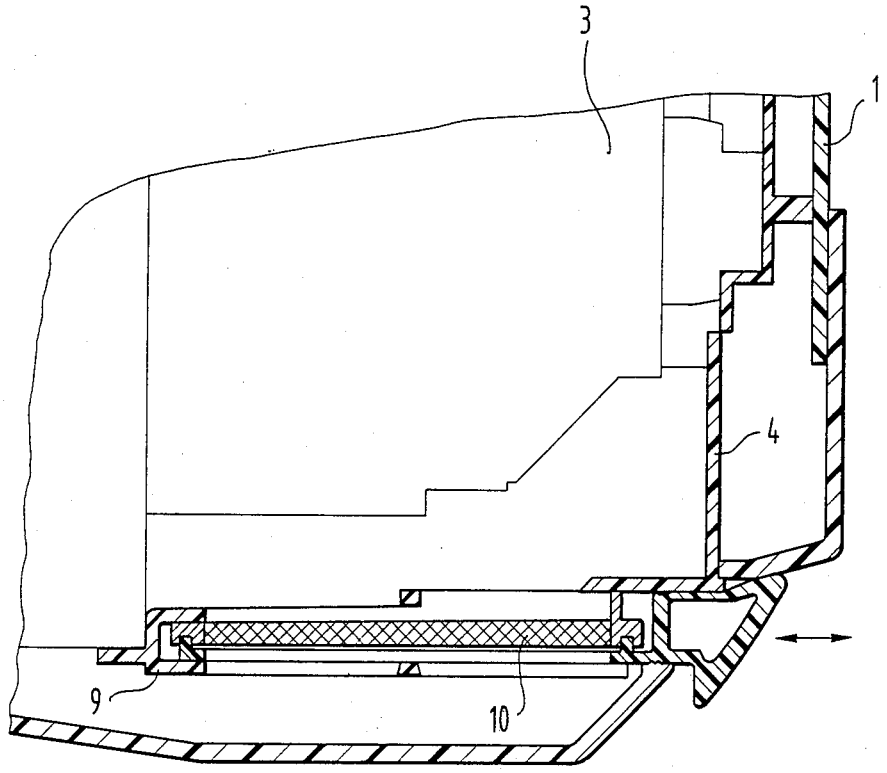
FIG. 4 is a longitudinal section taken through the main part of the motor space of a further working example of the vacuum cleaner in accordance with the invention.

In FIG. 4 the back part of the motor space of a floor-supported vacuum cleaner will be seen. In this form of the invention the frame 9 is molded on the lower side of the shroud 4 where it surrounds the openings 13 in the shroud wall. In this case the filter 10 is introduced horizontally from the back side of the vacuum cleaner housing 1 into the frame 9.

We claim:

1. A vacuum cleaner comprising a housing having a dust space that is provided with a dust bag as placed therein, a motor space having a blower and a motor for driving said blower, said blower being in communication with said dust space for drawing air through the dust space and into said motor space, a shroud connected with the exhaust of said blower and having a plurality of air outlet ports but otherwise surrounding such motor air-tightly, an air filter mounted on said shroud on the outside of said air outlet ports thereof in such a way that air emerging from said air outlet ports passes through said air filter, and air air space as defined between said shroud and said housing for receiving air as discharged through said air filter from said air outlet ports of said shroud, said housing including air exit ports through which air may be discharged from said air space, and said shroud including a valve member formed in the wall thereof, said valve member opening at a given gauge pressure in said shroud so that the air drawn in is able to emerge from said shroud.

2. A vacuum cleaner as specified in claim 1, and wherein said valve member comprises a flap formed in the wall of said shroud.

3. A vacuum cleaner as specified in claim 2, and wherein the opening of said flap may be selectively indicated optically, electrically and acoustically.

4. A vacuum cleaner comprising a housing having a dust space that is provided with a dust bag as placed therein, a motor space having a blower and a motor for driving said blower, said blower being in communication with said dust space for drawing air through the dust space and into said motor space, a shroud connected with the exhaust of said blower and having a plurality of air outlet ports but otherwise surrounding said motor air-tightly, an air filter mounted on said shroud on the outside of said air outlet ports thereof in such a way that air emerging from said air outlet ports passes through said air filter, a cassette frame within which is fitted said filter whereby the same may be bodily mounted on and removed from said shroud, said shroud including a frame surrounding the outlet ports thereof and into which said filter cassette frame may be inserted with an air-tight jointing effect, and an air space as defined between said shroud and said housing for receiving air as discharged through said air filter from said air outlet ports of said shroud, said housing including a plurality of air exit ports through which air may be discharged from said air space, said air exit ports being distributed over a substantial area of said housing and of a substantially large cross sectional area such that air as received by said housing is released through said air exit ports at a low pressure, said air exit ports of said housing being in juxtaposed relation to said air outlet ports of said shroud and said air space whereby air emerges with a low velocity and a wide distribution from the air exit ports of said housing.

5. A vacuum cleaner as specified in claim 4 and wherein said surrounding frame includes rails for supporting said filter cassette frame.

6. A vacuum cleaner as specified in either of claims 4 or 5 and wherein said filter is a fine filter and a handle is provided for said filter cassette frame.

7. A vacuum cleaner as specified in any of claims 1, 2, 3, 4 or 5, and wherein said shroud includes a bearing ring for said blower, ribs being provided for connection of said bearing ring to said shroud.

8. A vacuum cleaner as specified in any of claims 1, 2, 3, 4 or 5, and wherein said shroud consists of a material with elastomer components.

9. A vacuum cleaner comprising a housing having a dust space that is provided with a dust bag as placed therein, a motor space having a blower and a motor for driving said blower, said blower being in communication with said dust space for drawing air through the dust space and into said motor space, a shroud connected with the exhaust of said blower and having a plurality of air outlet ports but otherwise surrounding said motor air-tightly, an air filter mounted on said shroud on the outside of said air outlet ports thereof in such a way that air emerging from said air outlet ports passes through said air filter, a cassette frame within which is mounted said filter whereby the same may be bodily mounted on and removed from said shroud, said cassette frame including a handle to facilitate mounting and removal thereof from said shroud, said filter comprising a fine filter, and an air space as defined between said shroud and said housing for receiving air as discharged through said air filter from said air outlet ports of said shroud, said housing including a plurality of air exit ports through which air may be discharged from said air space, said air exit ports being distributed over a substantial area of said housing and of a substantially large cross sectional area such that air as received by said housing is released through said air exit ports at a low pressure, said air exit ports of said housing being in juxtaposed relation to said air outlet ports of said shroud and said air space whereby air emerges with a low velocity and a wide distribution from the air exit ports of said housing.

* * * * *